US011648550B2

(12) United States Patent
Döbele

(10) Patent No.: US 11,648,550 B2
(45) Date of Patent: May 16, 2023

(54) PIPETTE AND METHOD FOR ADJUSTING A VOLUME OF A PIPETTE TO BE PIPETTED

(71) Applicant: IKA-Werke GmbH & Co. KG, Staufen (DE)

(72) Inventor: Philip Döbele, Freiburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 984 days.

(21) Appl. No.: 16/349,825

(22) PCT Filed: Sep. 25, 2017

(86) PCT No.: PCT/EP2017/001141
§ 371 (c)(1),
(2) Date: May 14, 2019

(87) PCT Pub. No.: WO2018/086720
PCT Pub. Date: May 17, 2018

(65) Prior Publication Data

US 2019/0366323 A1 Dec. 5, 2019

(30) Foreign Application Priority Data

Nov. 14, 2016 (DE) ..... 10 2016 121 813.8

(51) Int. Cl.
*B01L 3/02* (2006.01)
*B01L 9/00* (2006.01)

(52) U.S. Cl.
CPC ..... *B01L 3/0279* (2013.01); *B01L 9/543* (2013.01); *B01L 3/021* (2013.01); *B01L 2200/04* (2013.01);
(Continued)

(58) Field of Classification Search
CPC ..... B01L 2200/0605; B01L 2200/143; B01L 2200/146; B01L 2200/147; B01L 2300/02;
(Continued)

(56) References Cited

U.S. PATENT DOCUMENTS 3,766,785 A 10/1973 Smernoff
4,084,730 A * 4/1978 Franke ..... B01L 3/022 73/864.18
(Continued)

FOREIGN PATENT DOCUMENTS

WO 2009118456 A1 3/2011
WO 2011025399 A2 3/2011
WO WO-2011025399 A2 * 3/2011 ..... B01L 3/0224

OTHER PUBLICATIONS

International Search Report from PCT Application No. PCT/EP2017/001141, dated Feb. 28, 2018.

*Primary Examiner* — John Fitzgerald
*Assistant Examiner* — Truong D Phan
(74) *Attorney, Agent, or Firm* — Budzyn IP Law, LLC

(57) ABSTRACT

In order for the handling of a pipette to be improved, the pipettes (1) according to the invention and a method according to the invention for setting a volume of a pipette to be pipetted are proposed. In the case of the pipette (1) it is provided that the activation element (7) for activating the ejection mechanism (6) for ejecting a pipette tip forms a conduit (9) for the pipetting button (3). On account thereof, an activation face (10) of the activation element (7) is enlarged in such a manner that the handling of the ejection mechanism (6) of the pipette (1) is in particular simplified and is particularly comfortable. It is furthermore also proposed that the activation element (7) is coupled to the volume adjustment mechanism (11) of the pipette, and the
(Continued)

adjustment of the volume to be pipetted by the pipette (1) is performed with the aid of a movement of the activation element (7)(FIG. 4).

34 Claims, 3 Drawing Sheets

(52) U.S. Cl.
CPC . *B01L 2200/087* (2013.01); *B01L 2400/0478* (2013.01)

(58) Field of Classification Search
CPC ..... B01L 2300/023; B01L 3/0237; B01L 2200/14; B01L 3/02; B01L 3/022; B01L 2200/00; B01L 2300/021; B01L 2300/0627; B01L 2300/0636; B01L 2300/0663; B01L 2300/0861; B01L 2300/12; B01L 2300/123; B01L 2300/14; B01L 2300/18; B01L 2300/1888; B01L 2400/0478; G01N 35/00871; G01N 35/1009; G01N 35/1016
See application file for complete search history.

(56) References Cited

U.S. PATENT DOCUMENTS

| | | | | |
|---|---|---|---|---|
| 4,988,481 | A | 1/1991 | Jarvimaki et al. | |
| 5,104,625 | A | 4/1992 | Kenney | |
| 6,295,880 | B1 | 10/2001 | Gilson | |
| 6,329,139 | B1 * | 12/2001 | Nova ..... | B01L 3/50255 506/40 |
| 2002/0041833 | A1 | 4/2002 | Telimaa et al. | |
| 2014/0298925 | A1 | 10/2014 | Voyeux et al. | |
| 2016/0051978 | A1 | 2/2016 | Voyeux et al. | |
| 2016/0303557 | A1 * | 10/2016 | LaCroix ..... | B01L 3/0224 |

* cited by examiner

PIPETTE AND METHOD FOR ADJUSTING A VOLUME OF A PIPETTE TO BE PIPETTED

FIELD OF THE INVENTION

The invention relates to a pipette having a pipetting button, having a pipette shaft, a pipette tip being capable of being plug-fitted or being plug-fitted to the free shaft end of said pipette shaft, and having an ejection mechanism comprising an activation element for ejecting a pipette tip that is plug-fitted to the free shaft end.

The invention furthermore also relates to a method for setting a volume of a pipette to be pipetted, in particular of a pipette according to the invention.

BACKGROUND OF THE INVENTION

Pipettes of this type and methods for setting a volume of a pipette to be pipetted in various embodiments are known from the prior art.

In the case of the pipettes of the type mentioned at the outset known from the prior art it is known, for example, for an activation element for activating the ejection mechanism of the pipette to be provided on an external side of a housing of the pipette. The position of the activation element on the housing is chosen from ergonomic viewpoints. The chosen position typically represents a compromise and does not afford an operation that is uniformly comfortable to each user.

Moreover, different concepts for setting a volume of a pipette to be pipetted are known from the prior art, said pipette in this instance also being able to be referred to as a volume-variable pipette. Concepts in which the volume setting of the pipette is performed by means of a volume setting element are inter alia known. The volume setting element herein is disposed on the pipette in such a manner that any unintentional adjustment of the pre-set volume is prevented between two pipetting procedures or else during one pipetting procedure. To this end, the volume setting element in the case of some of the previously known pipettes can be disposed so far from the pipetting button that any unintentional volume adjustment during the pipetting can be avoided in the orderly operation of the pipette. However, the accessibility of the volume setting element to a user can be restricted on account thereof.

SUMMARY OF THE INVENTION

It is an object of the invention to provide a pipette and a method for setting a volume of a pipette to be pipetted of the type mentioned at the outset by way of which handling of the pipette can be simplified.

This object is achieved according to the invention by a pipette having the means and features of claim 1. A pipette in which the activation element forms a conduit for the pipetting button such that an activation face of the activation element at least partially encloses a longitudinal axis of the pipetting button is in particular proposed in order for said object to be achieved. A pipette which, by virtue of the conduit which the activation element forms for the pipetting button, is designed in a particularly compact manner at least in a top region of the pipette, is achieved in this way. This is because the pipetting button is integrated in the activation element of the ejection mechanism. The design embodiment according to the invention of the pipette furthermore offers the advantage that the activation face of the activation element for ejecting a pipette tip that is plug-fitted thereto is enlarged in comparison to the pipettes known from the prior art.

It is thus possible, for example, for the activation face of the activation element to enclose the pipetting button in a specific angular range, thus for example in an angular range of 90°, 180°, 270°, or even 360°. An activation face for activating the activation element that is at least partially disposed around the pipetting button is thus available to the user. The ejection mechanism of the pipette according to the invention can thus be more accessible to a user, even in the case of potentially different holding positions at which the pipette is held by one user or by different users.

The object defined above is also achieved by a pipette having the means and features of claim 2. A pipette in which the activation element for actuating the volume adjustment mechanism and thus for adjusting the volume to be pipetted is specified, in particular also proposed, in order for the object defined at the outset to be achieved. In this way, the activation element, besides the ejection function of a pipette tip that is plug-fitted thereto, can also be assigned the function of adjusting the volume to be pipetted.

It is to be noted at this point that the two concepts defined above can be combined with one another according to the mention. A pipette of the type mentioned at the outset in which it is provided that the activation element forms a conduit for the pipetting button such that an activation face of the activation element at least partially encloses a longitudinal axis of the pipetting button and that the activation element is specified for actuating the volume adjustment mechanism and thus for adjusting the volume to be pipetted is thus also proposed for achieving the afore-mentioned object. A pipette having an activation element for activating the ejection mechanism of the pipette in which the activation element in terms of the activation face thereof is enlarged as compared to the pipettes known from the prior art, on the one hand, and in which the activation element, besides the function of activating the ejection mechanism, is also assigned the function of actuating the volume adjustment mechanism, is provided in this way. A separate volume adjustment element on the pipette which potentially interferes in the handling of the pipette can thus be dispensed with.

A particularly comfortable adjustment of the volume to be pipetted can be achieved when the activation element is configured as a rotary button. It can be particularly expedient in this context for the activation element to be configured as a rotary button which, for adjusting the volume to be pipetted, is rotatable about the longitudinal axis of the pipetting button. The configuration of the activation element as a rotary button can be advantageous above all for a precise setting of the volume to be pipetted.

The activation face of the activation element can be aligned so as to be transverse or else orthogonal to the longitudinal axis of the pipetting button. It is possible for the activation face of the pipetting button to enclose the longitudinal axis of the pipetting button in an annular, in particular a circular-annular, manner. The activation element can thus be configured in such a manner that said activation element, at least by way of the activation face thereof, completely surrounds the longitudinal axis of the pipetting button such that the longitudinal axis of the pipetting button and also the pipetting button are laterally surrounded on all sides by the activation face of the activation element. A pipette having an activation element for the ejection mechanism which is accessible for activation from the most varied directions is provided in this way. The ejection mechanism can thus be operated in a reliable and particularly comfortable manner even when the pipette is held at the most varied holding positions.

In terms of the accessibility of the pipetting button, and in order to prevent any unintentional triggering of the ejection mechanism, it can be advantageous for the pipetting button to axially protrude the activation face of the activation element, thus to project, in particularly in an upward manner, beyond the activation element.

It can furthermore be advantageous for the activation element, counter to a restoring force of a restoring element, to be movable from an initial position to an activation position. The restoring element can be a restoring spring, for example. A coil spring that is configured as a compression spring can expediently be used as the restoring element. The movement of the activation element from the initial position thereof to the activation position thereof herein can be performed by an axial displacement in the direction of the free shaft end of the pipette. The restoring action is then correspondingly performed axially in the opposite direction.

The ejection mechanism can comprise an ejection element which is movable relative to the pipette shaft. Said ejection element, by activating the activation element for ejecting a pipette tip that is plug-fitted to the free shaft end, can be displaceable relative to the pipette shaft in the direction of the free end of the pipette shaft, to the ejection position of said ejection element. The displacement of the ejection element herein can be performed in the axial direction in relation to a longitudinal axis of the pipette shaft.

The ejection element can be configured as an ejection sleeve or as an ejection sleeve segment which at least partially surrounds the pipette shaft.

The pipette can furthermore have a force-transmission element which connects the activation element to the afore-mentioned ejection element, and by way of which an activation force that is generated by activating the activation element is capable of being transmitted from the activation element to the ejection element. The use of a force-transmission element of this type can be advantageous in particular when the activation element is disposed on a top end of the pipette that is opposite the free shaft end, thus when a certain distance is to be bridged between the activation element and the ejection element.

The force-transmission element can comprise, for example, a force-transmission sleeve and/or at least one force-transmission arm. However, the force-transmission element can also have a force-transmission ring which is capable of being connected or is connected, preferably in a releasable manner, to the ejection element, at least one force-transmission arm of this type or a force-transmission sleeve of this type, either being capable of being connected or being connected to the activation element, engaging on said force-transmission ring.

It is to be mentioned that the ejection element, for example by way of an or the afore-mentioned force-transmission element, is connected to the activation element in such a manner that the ejection element, counter to the restoring force of the restoring element already mentioned above, can also be moved from an initial position to an ejection position or ejection status. The activation element, the ejection element, and also the force-transmission element, by virtue of the restoring force of the restoring element, can be automatically moved back to the respective initial position.

The pipette according to the invention can be imparted a particularly compact design when a diameter of the activation element is smaller than or equal to a diameter of a housing of the pipette. The activation element can thus be configured in such a manner that said activation element in the use position does not laterally project beyond a housing of the pipette. Any undesirable triggering of the ejection mechanism by any unintentional activation of the activation element can thus be avoided.

The pipette can be imparted a symmetrical construction when the pipetting button is disposed so as to be centric on an upper side or on a top part of a housing of the pipette, for example of the housing of the pipette already mentioned above. This has the result that a longitudinal axis of the pipette, a longitudinal axis of the pipette shaft, and/or a longitudinal axis or a rotation axis of the activation element, in as far as the latter is configured as a rotary button, is/are congruent with the longitudinal axis of the pipetting button.

The activation element in an initial position, for example the initial position already mentioned above, can be axially displaceable and rotationally fixed relative to a housing of the pipette, for example the housing of the pipette already mentioned above. When the activation element in the initial position is rotationally fixed relative to the housing of the pipette, any unintentional volume adjustment of the volume to be pipetted can be reliably avoided. This in particular when a rotating movement of the activation element is provided for changing the volume to be pipetted.

It is also possible for the activation element to be movable from an initial position, for example the initial position already mentioned above, to a volume adjustment position. This is particularly expedient when the activation element in the initial position thereof is disposed so as to be rotationally fixed on the housing such that setting a volume or changing a volume of the volume to be pipetted is suppressed in the initial position of the activation element. The activation element can be displaced, relative to the housing of the pipette, from the initial position to the volume adjustment position thereof in an axial manner in relation to the longitudinal axis of the pipetting button and also in relation to the longitudinal axis of the activation element.

In order to avoid that the activation element in the initial position thereof can be rotated and the volume to be pipetted is unintentionally adjusted, a locking mechanism, in particular a toothing, can be provided. The latter can be effective between the activation element and a further element of the pipette, at least when the activation element is situated in the initial position thereof and/or in the activation position thereof. In this context it can be advantageous for the locking mechanism of the activation element for rotationally securing the activation element in the initial position thereof to be releasable by the movement to the volume adjustment position of said activation element, such that said activation element in the volume adjustment position thereof on the housing is then rotatable for adjusting the volume to be pipetted. This in particular when the activation element is simultaneously configured as a rotary button.

The volume setting of the volume to be pipetted with the aid of the activation element can be performed in a particularly safe and precise manner when a radial face, in particular a circumferential face, of the activation element has an anti-slip structure, in particular a knurling, and/or an anti-slip coating.

The afore-mentioned object is also achieved by a method of the type mentioned at the outset for setting a volume of a pipette to be pipetted, in particular of a pipette according to the invention, having the means and features of the independent claim directed toward such a method. A method for setting a volume of a pipette to be pipetted, wherein the volume to be pipetted is set by means of an activation element of an ejection mechanism of the pipette for ejecting a pipette tip that is plug-fitted to a free shaft end of the pipette, said activation element being coupled to a volume adjustment mechanism of the pipette, is in particular proposed for achieving the object.

A particularly precise setting of the volume to be pipetted can be performed when the volume to be pipetted is set by rotating the activation element that is in particular configured as a rotary button. In order for the volume to be pipetted to be set, the activation element, in particular configured as a rotary button, can be rotated about a longitudinal axis of the pipette, about a longitudinal axis of a pipetting button, and/or about a longitudinal axis of the activation element.

In the case of one embodiment of the method a locking mechanism for rotationally securing the activation element in an initial position on the housing of the pipette can be released by a, preferably axial, movement of the activation element to a volume adjustment position on the housing, such that the activation element can be rotated for setting a volume to be pipetted. In order for the locking mechanism to be released, the activation element can be displaced axially on the housing, in particular raised, in relation to a longitudinal axis of the pipetting button, of the activation element, and/or of the pipette. The locking mechanism can be restored by a movement of the activation element in the opposite direction, thus from the volume adjustment position back to the initial position.

BRIEF DESCRIPTION OF THE DRAWINGS

An exemplary embodiment of the invention is described in more detail hereunder by means of the drawing. In part in a very schematic illustration.

DETAILED DESCRIPTION OF THE INVENTION

Figure 1:
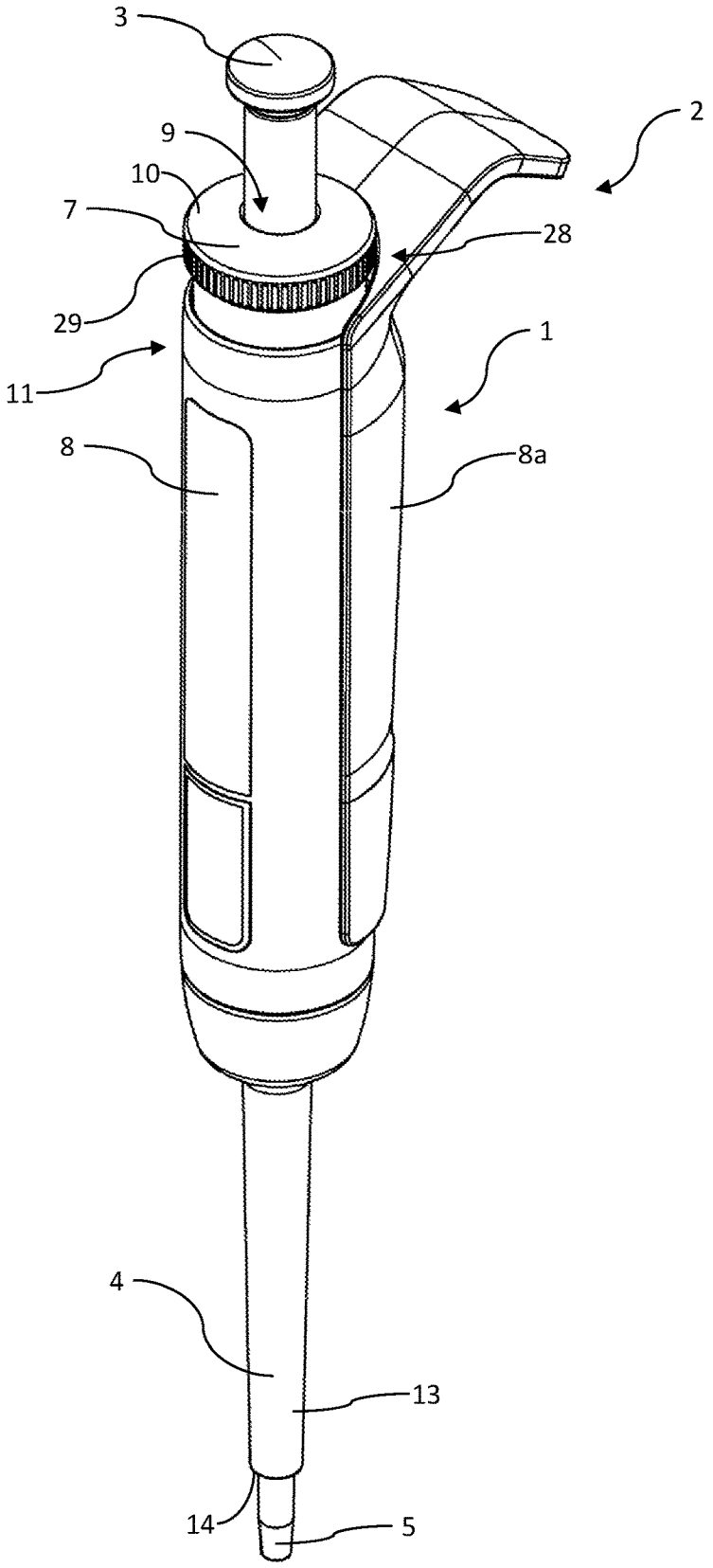
FIG. 1 shows a perspective view of a pipette according to the invention.

FIGS. 1 to 5 show a pipette which as an entity is identified by the reference sign 1 and which at a top end 2 has a pipetting button 3. A predefined volume of liquid can be received in a pipette tip and also be dispensed from the latter again by activating said pipetting button 3.

The pipette 1 moreover has a pipette shaft 4 that faces away from the top end 2, a pipette tip being capable of being plug-fitted to the free shaft end 5 of said pipette shaft 4 and in the use position of the pipette 1 being plug-fitted thereto.

In order for the pipette tip to be ejected, the pipette 1 is equipped with an ejection mechanism 6, which comprises an activation element 7 which likewise is provided in the region of the top end 2 on a housing 8 of the pipette 1. The ejection mechanism 6 is triggered when pushing the activation element 7 and a pipette tip that is plug-fitted to the free shaft end 5 is ejected from the pipette shaft 4.

The activation element 7 forms a conduit 9 for the pipetting button 3 such that an activation face 10 of the activation element 7 at least partially encloses or surrounds a longitudinal axis L of the pipetting button 3.

A grip 8*a* which is removable from the housing 8 of the pipette 1 is disposed on an external side of the housing 8, said grip 8*a* at the upper end thereof being configured so as to be hook-shaped.

The pipette 1 illustrated in FIGS. 1 to 5 moreover has a volume adjustment mechanism 11 which is specified for adjusting a volume to be pipetted by the pipette 1. The pipette 1 is thus a volume-variable pipette which moreover is capable of being operated mechanically in a manual manner.

The activation element 7 which serves for ejecting a pipette tip that is plug-fitted to the free shaft end 5 is also specified for actuating the volume adjustment mechanism 11 and thus for adjusting the volume to be pipetted. The activation element 7 is configured as a rotary button which is rotatable about the longitudinal axis L of the pipetting button 3. More specifically, the activation element 7 is configured as a push-and-rotate button, wherein pushing the activation element 7 also actuates and triggers the ejection mechanism 6, and rotating the activation element 7 triggers a volume adjustment of the volume to be pipetted.

The activation face 10 of the activation element 7 is aligned so as to be transverse to the longitudinal axis L of the pipetting button 3, and in regions is even aligned so as to be orthogonal to said longitudinal axis. Moreover, the activation face 10 surrounds the longitudinal axis L of the pipetting button 3 in an annular manner, in the case of the exemplary embodiment shown in the figures even in a circular-annular manner. The conduit 9 which the activation element 7 forms for the pipetting button 3 is thus delimited by the circular-annular activation face 10. The pipetting button 3 in the use position of the pipetting button 3 as well as of the activation element 7 is positioned in the conduit 9 of the activation element 7. The pipetting button 3 herein, in the use position thereof, is disposed on the housing 8 of the pipette 1 in the region of the top end 2 of the pipette 1 in such a manner that said pipetting button 3, in relation to the longitudinal axis L thereof, axially protrudes beyond the activation face 10 of the activation element 7.

The activation element 7, counter to a restoring force of a restoring element 12 which here is configured as a restoring spring, is movable from the initial position of said activation element 7 (cf. FIGS. 1 and 2, as well as 4 and 5) to the activation position of said activation element 7. The activation element 7 can be displaced axially in the direction of the free shaft end 5 of the pipette shaft 4 of the pipette 1 to said activation position when a specific activation pressure is exerted on the activation face 10 and the resistance of the restoring element 12 is overcome.

The ejection mechanism 6 comprises an ejection element 13 that is movable relative to the pipette shaft 4. The figures show that said ejection element 13 is configured as an ejection sleeve and therein receives the pipette shaft 4. The sleeve-shaped ejection element 13 for ejecting a pipette tip that is plug-fitted to the free shaft end 5, by activation of the activation element 7 is displaced relative to the pipette shaft 4, axially in relation to the longitudinal axis L of the pipetting button 3 and also in relation to the longitudinal central axis of the pipette shaft 4, in the direction of the free end 5 of the pipette shaft 4 to the ejection position of said activation element 7. An end face 14 of the sleeve-shaped ejection element 13 herein impacts a pipette tip that is plug-fitted to the free shaft end 5 and can then slide and release said pipette tip from the free shaft end 5.

The pipette 1 furthermore has a force-transmission element 15 which can be readily seen in the sectional illustrations. Depending on the embodiment of the pipette 1 according to the invention, said force-transmission element 15 can comprise a force-transmission sleeve or else, as is provided in the case of the exemplary embodiment of the pipette 1 illustrated in the figures, a specific number of individual force-transmission arms 17 which are connected to one another by way of a force-transmission ring 16.

The force-transmission element 15 connects the activation element 7 to the ejection element 13 and enables transmission of an actuation force, which is generated by activating the activation element 7, from the activation element 7 to the ejection element 13, and from the latter ultimately to a pipette tip that is plug-fitted to the free shaft end 5 of the pipette shaft 4. The activation element 7, the force-transmission element 15, and the ejection element 13 herein are connected to one another in such a manner that said elements, counter to the restoring force of the restoring element 12, can be collectively moved from the respective initial position to an ejection position or an ejection status. The restoring force of the restoring element 12 then also has the effect that all three afore-mentioned elements of the ejection mechanism 6 are automatically moved from the respective ejection position or ejection status back to the respective initial position as soon as the activation element 7 is released again.

All of the figures show that a diameter of the activation element 7 is smaller than a diameter of the housing 8 of the pipette 1, thus in relation to the longitudinal axis L of the pipetting button 3 does not laterally or radially project beyond an external housing wall of the housing 8.

The pipetting button 3 of the pipette 1 is disposed so as to be centric on an upper side of the top end 2 of the housing 8 of the pipette 1 such that a longitudinal axis of the pipette 1 is congruent with the longitudinal axis L of the pipetting button 3. It is to be noted that the longitudinal axis of the activation element 7, the longitudinal central axis of the pipette shaft 4, and the longitudinal axis L of the pipetting button 3 are also congruent.

Figure 2:
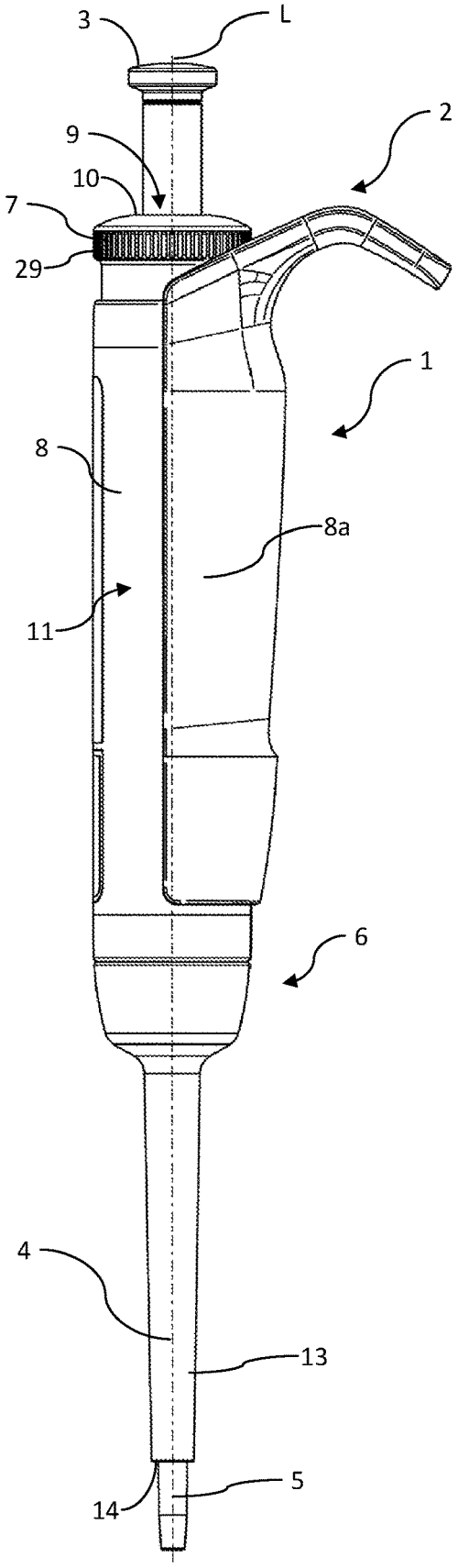
FIG. 2 shows a first lateral view of the pipette illustrated in FIG. 1, wherein the activation element is illustrated in the non-activated initial position thereof.
Figure 3:
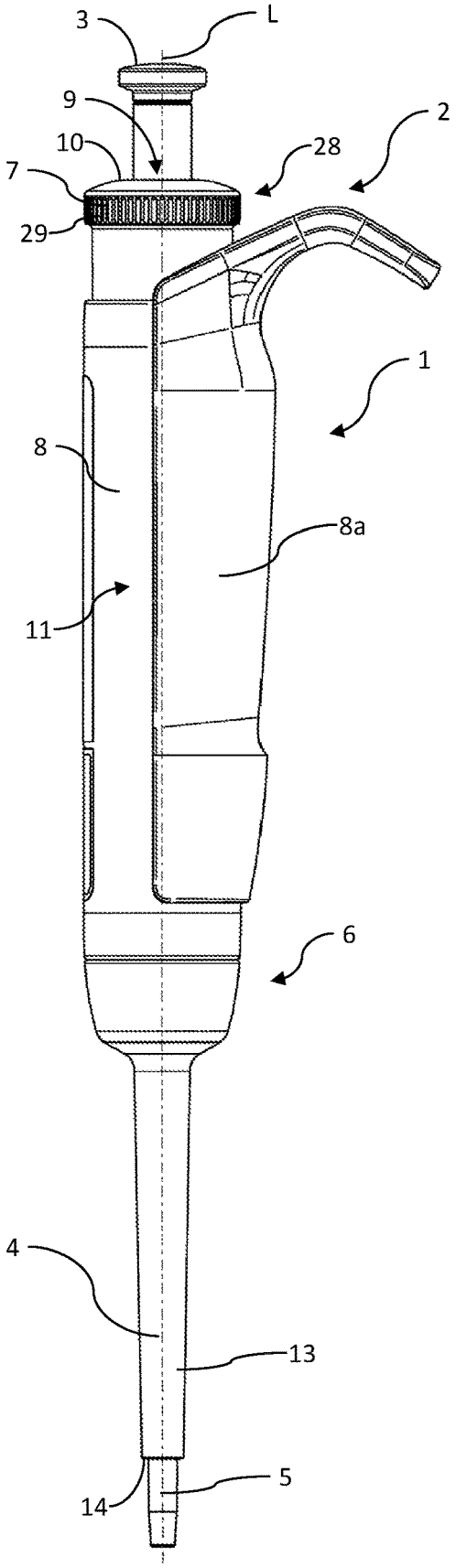
FIG. 3 shows a first lateral view of the pipette illustrated in FIGS. 1 and 2, wherein the activation element here is shown in the axially pulled-upward volume adjustment position thereof.
Figure 4:
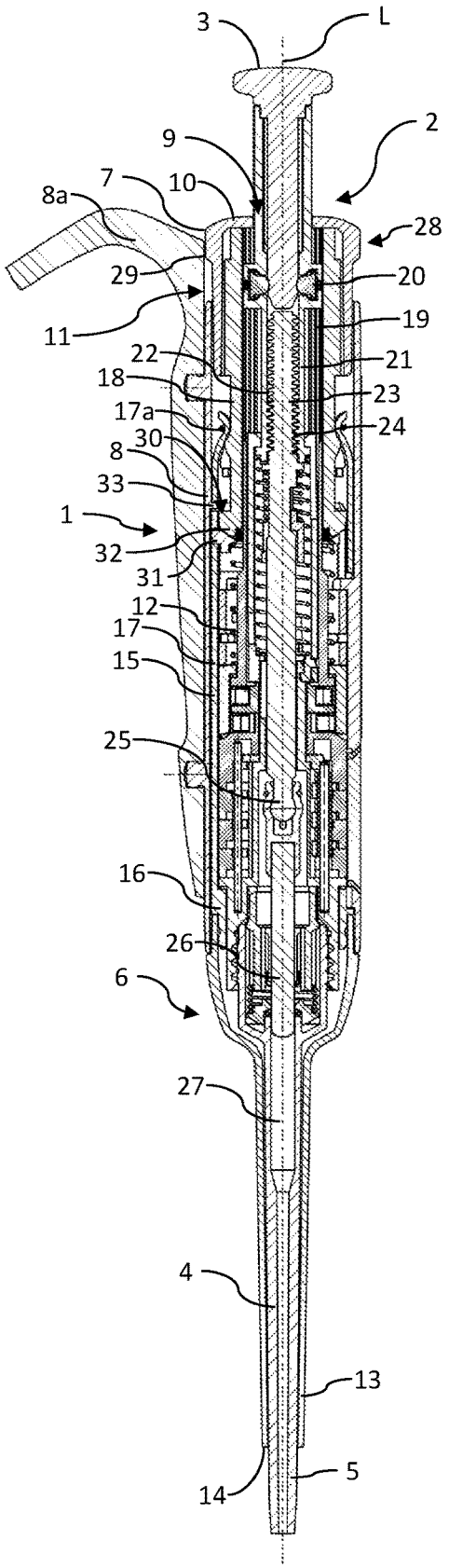
FIG. 4 shows a first sectional lateral view of the pipette illustrated in FIGS. 1 to 3, wherein a centrically disposed pipetting button and the activation element, surrounding the latter, for activating the ejection mechanism of the pipette can be seen in a top part of the pipette.
Figure 5:
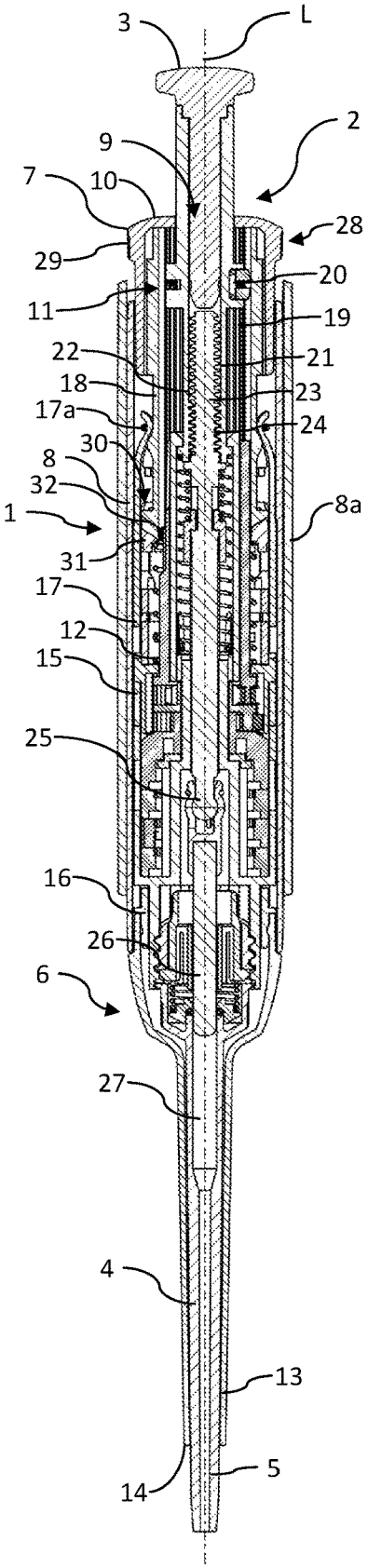
FIG. 5 shows a further sectional lateral view of the pipette illustrated in the preceding figures, said lateral view being rotated by 90° in the clockwise direction as compared to FIG. 4.

The activation element 7 in the initial position thereof illustrated in FIGS. 1 and 2 as well as 4 and 5 is disposed so as to be displaceable relative to the housing 8 of the pipette 1 both in an axially downward as well as upward manner, but so as to be rotationally fixed relative to the housing 8. In order for the activation element 7 to be moved from the initial position thereof to a volume adjustment position which is illustrated in FIG. 3, the activation element 7, in relation to the longitudinal axis L of the pipetting button 1, is axially displaced upward or raised relative to the housing 8 and relative to the pipetting button 3 of the pipette 1. This is performed counter to the force of an annular spring 17*a* which surrounds a sleeve-shaped appendage 18 of the activation element 7.

For the adjustment of the volume to be pipetted, the activation element 7 in the volume adjustment position can be rotated about the longitudinal axis L of the pipetting button 3, relative to the housing 8. The activation element 7 in the volume adjustment position thereof is thus rotatable relative to the housing 8 of the pipette 1.

As has already been explained above, the activation element 7 in the initial position thereof, and also in the activated position thereof for dispensing a liquid, is not rotatable but rotationally fixed relative to the housing 8. Any unintentional volume adjustment can thus be prevented. The activation element 7 in the initial position and in the activated position thereof is rotationally fixed relative to the housing 8 by virtue of a locking mechanism 30. Said locking mechanism 30 is configured as a toothing 30 and is effective between the sleeve-shaped appendage 18 of the activation element 7 and a toothed compression ring 31. The toothed compression ring 31 is connected in a rotationally fixed manner to the force-transmission element 15 but is axially displaceable relative to the latter. The activation element 7 on the sleeve-shaped appendage 18 has a gear rim 32 which in the initial position and in the activation position of the activation element 7 engages in teeth of the toothed compression ring 31. On account thereof, the activation element 7 is fixed in terms of its rotated position.

The restoring spring 12 pushes the toothed compression ring 31 against an annular detent 33 which is configured on the internal side of the housing 8. In the activation of the activation element 7, thus when the activation element 7 is pushed downward and is displaced in the axial direction, said activation element 7 by way of the gear rim 32 pushes onto the toothed compression ring 31 and displaces the latter, counter to the restoring force of the restoring spring 12, in an axially downward manner. The rotationally fixed locking mechanism of the activation element 7 herein is also maintained in the activated position.

When the activation element 7 is displaced from the initial position thereof to the volume adjustment position, thus is moved in an axially upward manner, the toothing 30 is released, and the activation element 7 for the volume adjustment of the pipette 1 can be rotated about the longitudinal axis L. This is possible since the toothed compression ring 31 is held back by the annular detent 33 such that said toothed compression ring 31 can no longer follow the activation element 7 that is displaced to the volume adjustment position of said activation element 7, the toothing 30 being released on account thereof.

The volume adjustment of the pipette 1 herein is performed as described hereunder. The sleeve-shaped appendage 18 which is connected in a rotationally fixed manner to the activation element 7 has an internal toothing 19. Radially outwardly directed external teeth 20 of a spindle sleeve 21 engage in said internal toothing 19. Said spindle sleeve 21 herein is a component part of the pipetting button 3. The spindle sleeve 21 is thus also set in rotation by rotating the activation element 7. The spindle sleeve 21 in turn has an internal thread 22 in which a spindle 23 having an external thread 24 is positioned. When turning the spindle sleeve 21 relative to the spindle 23, the spindle 23 in a manner corresponding to the rotation direction is driven into the spindle sleeve 21 or is driven out of the latter. The spindle 23 at a distal end 25 is connected to a piston 26 of the pipette 1. Depending on the driven-in depth of the spindle 23 in the spindle sleeve 21, the piston 26 is pushed into a cylinder 27 of the pipette 1 to a variable degree. The deeper the piston 26 is pushed into the cylinder 27, the smaller the volume to be pipetted by the pipette 1.

FIG. 1 shows particularly well that a radial face 28 of the activation element 7 has an anti-slip structure in the form of a knurling 29.

In order for a volume to be pipetted by the pipette 1 according to the invention to be adjusted or set, the activation element 7 of the ejection mechanism 6 of the pipette 1, said activation element 7 being capable of being coupled to the volume adjustment mechanism 11 and in the use position being coupled to the latter, is specified for ejecting a pipette tip that is plug-fitted to the free shaft end 5 of the pipette 1. This is performed in that the activation element 7 from the initial position thereof is displaced, relative to the housing 8 of the pipette 1, in an axial manner in relation to the longitudinal axis L of the pipetting button 3, to a volume adjustment position. On account thereof, the toothing 30 is released, as has been described above. The activation element 7 is thus rotatable in order for the volume to be adjusted. When the activation element 7 in the volume adjustment position thereof on the housing 8 of the pipette 1 is rotated about the longitudinal axis of said activation element 7, about a longitudinal axis of the pipette 1, and about the longitudinal axis L of the pipetting button 3, an increase or a decrease in the volume to be pipetted is performed, depending on the rotation direction.

In order for the handling of a pipette to be improved, the pipette 1 according to the invention and a method according to the invention for setting a volume of a pipette to be pipetted are proposed. In the case of the pipette 1 it is provided that the activation element 7, for the activation of the ejection mechanism 6 for ejecting a pipette tip, forms a conduit 9 for the pipetting button 3. On account thereof, an activation face 10 of the activation element 7 is enlarged in such a manner that the operation of the ejection mechanism 6 of the pipette 1 is in particular simplified and is particularly comfortable. It is furthermore also proposed that the activation element 7 is coupled to the volume adjustment mechanism 11 of the pipette, and that the adjustment of the volume to be pipetted by the pipette 1 is performed with the aid of a movement of the activation element 7.

What is claimed is:

1. A pipette (1) having a pipetting button (3), a pipette shaft (4), a pipette tip being capable of being plug-fitted or being plug-fitted to a free shaft end (5) of said pipette shaft (4), an ejection mechanism (6), the ejection mechanism (6) including an activation element (7) for ejecting a pipette tip that is plug-fitted to the free shaft end (5), and a volume adjustment mechanism (11) for adjusting a volume to be pipetted by the pipette (1), wherein the activation element (7) forms a conduit (9) for the pipetting button (3) such that an activation face (10) of the activation element (7) at least partially encloses a longitudinal axis (L) of the pipetting button (3), and wherein the activation element (7) is specified for actuating the volume adjustment mechanism (11) and thus for adjusting the volume to be pipetted.

2. The pipette as claimed in claim 1, wherein the activation element (7) is configured as a rotary button which, for adjusting the volume to be pipetted, is rotatable about the longitudinal axis (L) of the pipetting button (3).

3. The pipette (1) as claimed in claim 1, wherein the activation face (10) is aligned so as to be transverse to the longitudinal axis (L) of the pipetting button (3).

4. The pipette (1) as claimed in claim 1, wherein the activation element (7), counter to a restoring force of a restoring element (12), is movable from an initial position axially in the direction of the free shaft end (5) to an activation position.

5. The pipette (1) as claimed in claim 1, wherein the ejection mechanism (6) comprises an ejection element (13) which, by activating the activation element (7) for ejecting a pipette tip that is plug-fitted to the free shaft end (5), is movable relative to the pipette shaft (4) in the direction of the free end (5) of the pipette shaft (4), to the ejection position of said ejection element (13).

6. The pipette (1) as claimed in claim 1, wherein a diameter of the activation element (7) is smaller than or equal to a diameter of a housing (8) of the pipette (1).

7. The pipette (1) as claimed in claim 1, wherein the pipetting button (3) is disposed so as to be centric on an upper side of a housing (8) of the pipette (1) such that a longitudinal axis of the pipette (1) is congruent with the longitudinal axis (L) of the pipetting button (3).

8. The pipette (1) as claimed in claim 1, wherein the activation face (10) encloses in an annular manner the longitudinal axis (L) of the pipetting button (3).

9. The pipette (1) as claimed in claim 1, wherein the pipetting button (3) axially protrudes from the activation face (10).

10. The pipette (1) as claimed in claim 1, wherein the pipette (1) has a force-transmission element (15) which connects the activation element (7) to the ejection element (13) such that an actuation force that is generated by activating the activation element (7) is transmitted from the activation element (7) to the ejection element (13) by way of said force-transmission element (15).

11. The pipette (1) as claimed in claim 10, wherein the force-transmission element (15) is at least one force-transmission arm (17) extending from a force-transmission ring (16).

12. The pipette (1) as claimed in claim 1, wherein a radial face (28) of the activation element (7) has one or more of an anti-slip structure and an anti-slip coating.

13. The pipette (1) as claimed in claim 12, wherein the anti-slip structure includes knurled surface.

14. The pipette (1) as claimed in claim 1, wherein the activation element (7) in an initial position is axially displaceable and rotationally fixed relative to a housing (8) of the pipette (1).

15. The pipette as claimed in claim 14, wherein the activation element (7) is axially displaceable from the initial position to a volume adjustment position for adjusting a volume to be pipetted.

16. The pipette (1) as claimed in claim 15, wherein a locking mechanism (30) of the activation element (7) is provided for rotationally securing the activation element (7) in the initial position thereof, the locking mechanism (30) being releasable by the movement to the volume adjustment position of said activation element (7) such that said activation element (7) for adjusting the volume to be pipetted in the volume adjustment position of said activation element (7) is rotatable relative to the housing (8).

17. A method for setting a volume of a pipette (1) to be pipetted, in particular of a pipette (1) having a pipetting button (3), a pipette shaft (4), a pipette tip being capable of being plug-fitted or being plug-fitted to a free shaft end (5) of said pipette shaft (4), and an ejection mechanism (6), the ejection mechanism (6) including an activation element (7) for ejecting a pipette tip that is plug-fitted to the free shaft end (5), wherein the activation element (7) forms a conduit (9) for the pipetting button (3) such that an activation face (10) of the activation element (7) at least partially encloses a longitudinal axis (L) of the pipetting button (3), wherein the volume to be pipetted is set by means of the activation element (7) of the ejection mechanism (6) of the pipette (1) for ejecting a pipette tip that is plug-fitted to the free shaft end (5) of the pipette (1), said activation element (7) being capable of being coupled to a volume adjustment mechanism (11) of the pipette (1).

18. The method as claimed in claim 17, wherein the volume to be pipetted is set by rotating the activation element (7) about a longitudinal axis of the pipette (1).

19. The method as claimed in claim 17, wherein a locking mechanism is provided for rotationally securing the activation element (7) in an initial position on a housing (8) of the pipette (1), wherein the locking mechanism is released by a movement of the activation element (7) from the initial position to a volume adjustment position on the housing (8) of the pipette (1) such that the activation element (7) is rotated for setting a volume to be pipetted.

20. A pipette (1) having a pipetting button (3), a pipette shaft (4), a pipette tip being capable of being plug-fitted or being plug-fitted to a free shaft end (5) of said pipette shaft (4), and an ejection mechanism (6), the ejection mechanism (6) including an activation element (7) for ejecting a pipette tip that is plug-fitted to the free shaft end (5), wherein the activation element (7) forms a conduit (9) for the pipetting button (3) such that an activation face (10) of the activation element (7) at least partially encloses a longitudinal axis (L) of the pipetting button (3), wherein the activation element (7) in an initial position is axially displaceable and rotationally fixed relative to a housing (8) of the pipette (1), and wherein the activation element (7) is axially displaceable from the initial position to a volume adjustment position for adjusting a volume to be pipetted.

21. The pipette (1) as claimed in claim 20, further comprising a volume adjustment mechanism (11) for adjusting a volume to be pipetted by the pipette (1), wherein the activation element (7) is specified for actuating the volume adjustment mechanism (11) and thus for adjusting the volume to be pipetted.

22. The pipette as claimed in claim 20, wherein the activation element (7) is configured as a rotary button which, for adjusting the volume to be pipetted, is rotatable about the longitudinal axis (L) of the pipetting button (3).

23. The pipette (1) as claimed in claim 20, wherein the activation face (10) is aligned so as to be transverse to the longitudinal axis (L) of the pipetting button (3).

24. The pipette (1) as claimed in claim 20, wherein the activation element (7), counter to a restoring force of a restoring element (12), is movable from an initial position axially in the direction of the free shaft end (5) to an activation position.

25. The pipette (1) as claimed in claim 20, wherein the ejection mechanism (6) comprises an ejection element (13) which, by activating the activation element (7) for ejecting a pipette tip that is plug-fitted to the free shaft end (5), is movable relative to the pipette shaft (4) in the direction of the free end (5) of the pipette shaft (4), to the ejection position of said ejection element (13).

26. The pipette (1) as claimed in claim 20, wherein a diameter of the activation element (7) is smaller than or equal to a diameter of a housing (8) of the pipette (1).

27. The pipette (1) as claimed in claim 20, wherein the pipetting button (3) is disposed so as to be centric on an upper side of a housing (8) of the pipette (1) such that a longitudinal axis of the pipette (1) is congruent with the longitudinal axis (L) of the pipetting button (3).

28. The pipette (1) as claimed in claim 20, wherein the activation face (10) encloses in an annular manner the longitudinal axis (L) of the pipetting button (3).

29. The pipette (1) as claimed in claim 20, wherein the pipetting button (3) axially protrudes from the activation face (10).

30. The pipette (1) as claimed in claim 20, wherein a locking mechanism (30) of the activation element (7) is provided for rotationally securing the activation element (7) in the initial position thereof, the locking mechanism (30) being releasable by the movement to the volume adjustment position of said activation element (7) such that said activation element (7) for adjusting the volume to be pipetted in the volume adjustment position of said activation element (7) is rotatable relative to the housing (8).

31. The pipette (1) as claimed in claim 20, wherein the pipette (1) has a force- transmission element (15) which connects the activation element (7) to the ejection element (13) such that an actuation force that is generated by activating the activation element (7) is transmitted from the activation element (7) to the ejection element (13) by way of said force-transmission element (15).

32. The pipette (1) as claimed in claim 31, wherein the force-transmission element is at least one force-transmission arm (17) extending from a force-transmission ring (16).

33. The pipette (1) as claimed in claim 20, wherein a radial face (28) of the activation element (7) has one or more of an anti-slip structure and an anti-slip coating.

34. The pipette (1) as claimed in claim 33, wherein the anti-slip structure includes knurled surface.

* * * * *